US007215905B2

(12) United States Patent
Kamimura

(10) Patent No.: US 7,215,905 B2
(45) Date of Patent: May 8, 2007

(54) IMAGE FORMING APPARATUS AND PROCESS CARTRIDGE

(75) Inventor: Naoya Kamimura, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 64 days.

(21) Appl. No.: 10/792,855

(22) Filed: Mar. 5, 2004

(65) Prior Publication Data

US 2004/0175203 A1 Sep. 9, 2004

(30) Foreign Application Priority Data

Mar. 7, 2003 (JP) ..... 2003-062401

(51) Int. Cl.
*G03G 21/18* (2006.01)

(52) U.S. Cl. ..... 399/114; 399/113

(58) Field of Classification Search ..... 399/114, 399/113, 111, 110, 125
See application file for complete search history.

(56) References Cited

U.S. PATENT DOCUMENTS 5,153,640 A 10/1992 Okabe
5,787,324 A 7/1998 Iwasaki
5,991,570 A * 11/1999 Haga et al. ..... 399/114
6,101,351 A * 8/2000 Suda et al. ..... 399/114
6,453,135 B1 9/2002 Sameshima et al.

FOREIGN PATENT DOCUMENTS

| | | |
|---|---|---|
| JP | A-UM-3-016156 | 2/1991 |
| JP | A 3-248165 | 11/1991 |
| JP | UM-A-3-110454 | 11/1991 |
| JP | A-063359 | 2/1992 |
| JP | A-134458 | 5/1992 |
| JP | A 7-230197 | 8/1995 |
| JP | A-8-069240 | 3/1996 |
| JP | A 9-141972 | 6/1997 |
| JP | A-2001-142378 | 5/2001 |
| JP | A 2002-202707 | 7/2002 |

* cited by examiner

*Primary Examiner*—Louis M. Arana
(74) *Attorney, Agent, or Firm*—Oliff & Berridge, PLC

(57) ABSTRACT

A color laser printer includes chargers for charging the photosensitive drums as an image carrier on which a toner image for each print color is formed. Each charger is supported by a frame member provided rotatably around a central axis of a photosensitive drum. When a closing door is moved from a closed position where an opening portion is closed to an opened position where the opening portion is opened, the frame member is moved in conjunction with the operation, from a first position where the charger charges the photosensitive drum to a second position where a part of the opening portion in the photosensitive drum is covered.

20 Claims, 8 Drawing Sheets

IMAGE FORMING APPARATUS AND PROCESS CARTRIDGE

BACKGROUND OF THE INVENTION

1. Field of the Invention

The present invention relates to an image forming apparatus for forming the image using electrophotographic method, and a process cartridge used for the image forming apparatus.

2. Description of the Related Art

Conventionally, there have been well known an image forming apparatuses for forming the image using electrophotographic method.

For example, in JP-A-9-141972, an image forming apparatus having four image carriers (photosensitive members) arranged in the vertical direction is disclosed (see pages 4 through 9 and FIGS. 1 and 2). In the image forming apparatus disclosed in JP-A-9-141972, a sheet conveying belt is provided in contact with the four image carriers, and the sheet is conveyed by the sheet conveying belt to make contact with each image carrier successively, so that the image for each print color is transferred onto the sheet. Also, in this image forming apparatus, the sheet conveying belt is supported inside a front lid, and the entire conveyance path on which the sheet is conveyed is exposed to the user by opening the front lid, whereby a removal process for removing a sheet jam is simply performed.

The above document, JP-A-141972, has a corresponding U.S. patent application, in which the patent number thereof is U.S. Pat. No. 5,787,324.

SUMMARY OF THE INVENTION

However, in the configuration described above, the user can easily touch the image carriers by opening the front lid, resulting in a problem that the image carrier is prone to be contaminated or damaged.

It is therefore an object of the invention is to provide an image forming apparatus and a process cartridge in which the image carrier is prevented from being touched by the user.

In order to achieve the object, according to a first aspect of the invention, there is provided an image forming apparatus including: an image carrier that carries a developer image formed by developing an electrostatic latent image with a developer; a processing device configured to act on the image carrier; a frame member disposed to be movable with respect to the image carrier, the frame member supporting the processing device; a main frame formed with an opening portion facing the image carrier; a lid member disposed to be movable between an opened position in which the opening portion is opened and a closed position in which the opening portion is closed: and a moving mechanism configured to move the frame member, in conjunction with an operation of the lid member, between a first position in which the processing device acts on the image carrier and a second position in which the frame member covers a part of the image carrier.

According to a second aspect of the invention, there is provided a process cartridge mounted on an image forming apparatus, the process cartridge including: an image carrier that carries a developer image formed by developing an electrostatic latent image with a developer; a processing device configured to act on the image carrier: a frame member that support the process device and disposed to be movable between a first position in which the processing device acts on the image carrier and a second position in which different from the first position; and a holding mechanism that holds the frame member at the second position in a state where the process cartridge is detached from the image forming apparatus.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of a preferred embodiment of the invention.

Figure 1:
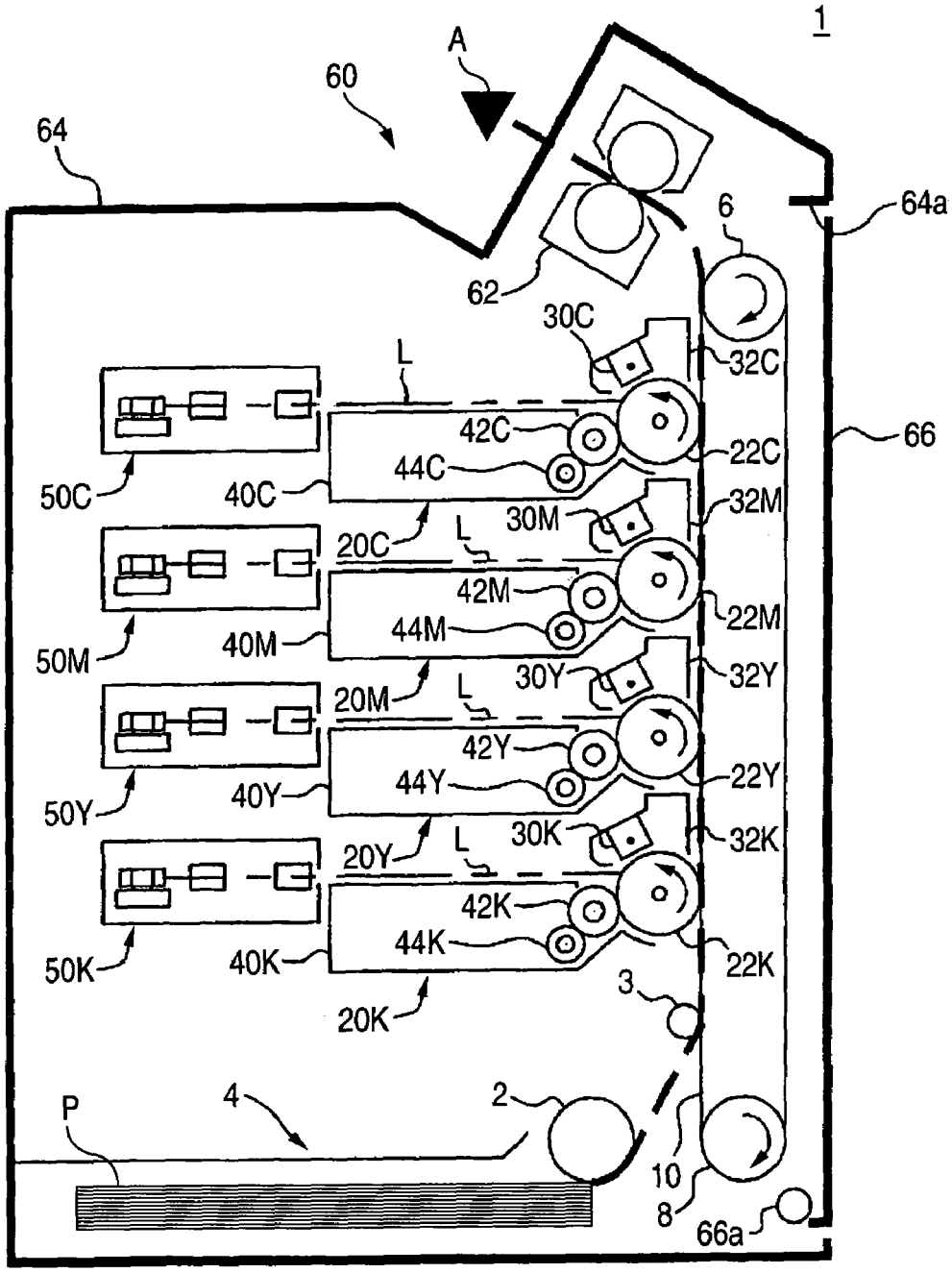
FIG. 1 is a schematic side cross-sectional view of a color laser printer according to an embodiment of the present invention.

FIG. 1 is a schematic side cross-sectional view for explaining an internal constitution of a color laser printer 1 as an image forming apparatus according to an embodiment of the invention.

As shown in FIG. 1, the color laser printer 1 corresponds to a so-called tandem type, and includes a sheet feeding portion 4 for supplying a sheet P one by one with a sheet feeding roller 2 and a conveying roller 3, a sheet conveying belt 10, looped over a drive roller 6 and a follower roller 8, for conveying the sheet P supplied from the sheet feeding portion 4 in the vertical upper direction, four process cartridges 20K, 20Y, 20M and 20C and four laser scanner units 50K, 50Y, 50M and 50C for forming the toner image corresponding to each print color of black (K), yellow (Y), magenta (M) and cyan (C) on the sheet P conveyed by the sheet conveying belt 10, a fixing unit 62 for fixing the toner image transferred onto the sheet P and exhausting the sheet to a sheet exhausting portion 60, a main frame 64 for storing each unit or portion to form an appearance of the printer, and a lid member 66 for opening or closing an opening portion 64*a* provided on a front face of the main frame 64 (on the right side in FIG. 1).

Each process cartridge 20K, 20Y, 20M and 20C includes a photosensitive drum 22K, 22Y, 22M and 22C, a charger 30K, 30Y, 30M and 30C, and a developing unit 40K, 40Y, 40M and 40C.

The photosensitive drum 22K, 22Y, 22M and 22C is a drum type electrophotographic photosensitive body in which an organic photoconductive layer (OPC photosensitive member) is coated on the outer circumferential face of a drum main body made of aluminum. And the photosensitive drum 22K, 22Y, 22M and 22C has its central axis (axis perpendicular to the sheet face in FIG. 1) borne by the developing unit 40K, 40Y, 40M and 40C, and driven for rotation in the arrow direction (counterclockwise in FIG. 1) by a drive motor, not shown.

Each charger 30K, 30Y, 30M and 30C is supported, with a certain gap apart, by a frame member 32K, 32Y, 32M and 32C provided to be rotatable, independently of the photosensitive drum 22K, 22Y, 22M and 22C, around the central axis of the photosensitive drum 22K, 22Y, 22M and 22C as the rotation axis, so as to be out of contact with the photosensitive drum 22K, 22Y, 22M and 22C. This charger 30K, 30Y, 30M and 30C is a so-called Scorotron type for positive charging to produce a corona discharge from the charging wire made of tungsten, and constituted to positively charge uniformly the surface of the photosensitive drum 22K, 22Y, 22M and 22C.

Each developing unit 40K, 40Y, 40M and 40C comprises a developing roller 42K, 42Y, 42M and 42C supplying the toner onto the photosensitive drum 22K, 22Y, 22M and 22C, and a supply roller 44K, 44Y, 44M and 44C supplying the toner to the developing roller 42K, 42Y, 42M and 42C.

Each laser scanner unit 50K, 50Y, 50M and 50C directs a laser beam L onto the photosensitive drum 22K, 22Y, 22M and 22C of the corresponding process cartridge 20K, 20Y, 20M and 20C, and scans the laser beam L along a direction of the rotation axis of the photosensitive drum 22K, 22Y, 22M and 22C.

Hereinafter, a basic operation of the color laser printer 1 will be briefly described below.

In the process cartridge 20K, 20Y, 20M and 20C, the surface of the photosensitive drum 22K, 22Y, 22M and 22C is positively charged uniformly by the charger 30K, 30Y, 30M and 30C, along with the rotation of the photosensitive drum 22K, 22Y, 22M and 22C, and exposed by fast scanning of laser beam L from the laser scanner unit 50K, 50Y, 50M and 50C to form an electrostatic latent image corresponding to each print color.

Then, when the positively charged toner carried on the developing roller 42K, 42Y, 42M and 42C is opposed to and makes contact with the photosensitive drum 22K, 22Y, 22M and 22C, with the rotation of the developing roller 42K, 42Y, 42M and 42C, the toner is supplied to the electrostatic latent image formed on the surface of the photosensitive drum 22K, 22Y, 22M and 22C, namely, an exposure portion exposed to laser beam L and having lower potential on the uniformly, positively charged surface of the photosensitive drum 22K, 22Y, 22M and 22C, and selectively carried to form the toner image.

On the other hand, the sheet P is supplied from the sheet feeding portion 4 between the conveying roller 3 and the sheet conveying belt 10, conveyed in an upper direction by the sheet conveying belt 10, and exhausted via the fixing unit 62 into the sheet exhausting portion 60, as indicated by the arrow A.

And the toner image formed on the surface of the photosensitive drum 22K, 22Y, 22M and 22C is successively transferred onto the sheet P conveyed by the sheet conveying belt 10. Herein, the toner image for each color is formed with a slight time difference according to the moving speed of the sheet conveying belt 10 and the distance between the photosensitive drums 22K, 22Y, 22M and 22C, and thereby transferred onto the sheet P and superposed thereon to form a color image.

Lastly, the toner image transferred onto the sheet P is fixed on the sheet P by the fixing unit 62. Then, the sheet P is exhausted into the sheet exhausting portion 60.

In the color laser printer 1, a process cartridge 20K, 20Y, 20M and 20C is mounted or demounted via an opening portion 64*a* in a state where the lid member 66 is opened.

That is, in the color laser printer 1, the lid member 66 is opened or closed by rotation around a rotation axis 66*a* parallel to the rotation axis of the photosensitive drum 22K, 22Y, 22M and 22C. Furthermore, the drive roller 6 and the follower roller 8 are supported inside the lid member 66. Therefore, if the lid member 66 is opened, the sheet conveying belt 10 is moved integrally with the lid member 66, 80 that the process cartridge 20K, 20Y, 20M and 20C is exposed to the opening portion 64*a*.

However, since the process cartridge 20K, 20Y, 20M and 20C is exposed to the opening portion 64*a* in the way described above, the user may touch the photosensitive drum 22K, 22Y, 22H and 22C.

Thus, in the color laser printer 1, the frame member 32K, 32Y, 32M and 32C in the process cartridge 20K, 20Y, 20M and 20C is moved from a first position where the charger 30K, 30Y, 30M and 30C charges the photosensitive drum 22K, 22Y, 22M and 22C to a second position of covering a part of the opening portion 64*a* in the photosensitive drum 22K, 22Y, 22M and 22C in conjunction with an opening or closing operation of the lid member 66, as shown in FIGS. 1 through 4.

Figure 2:
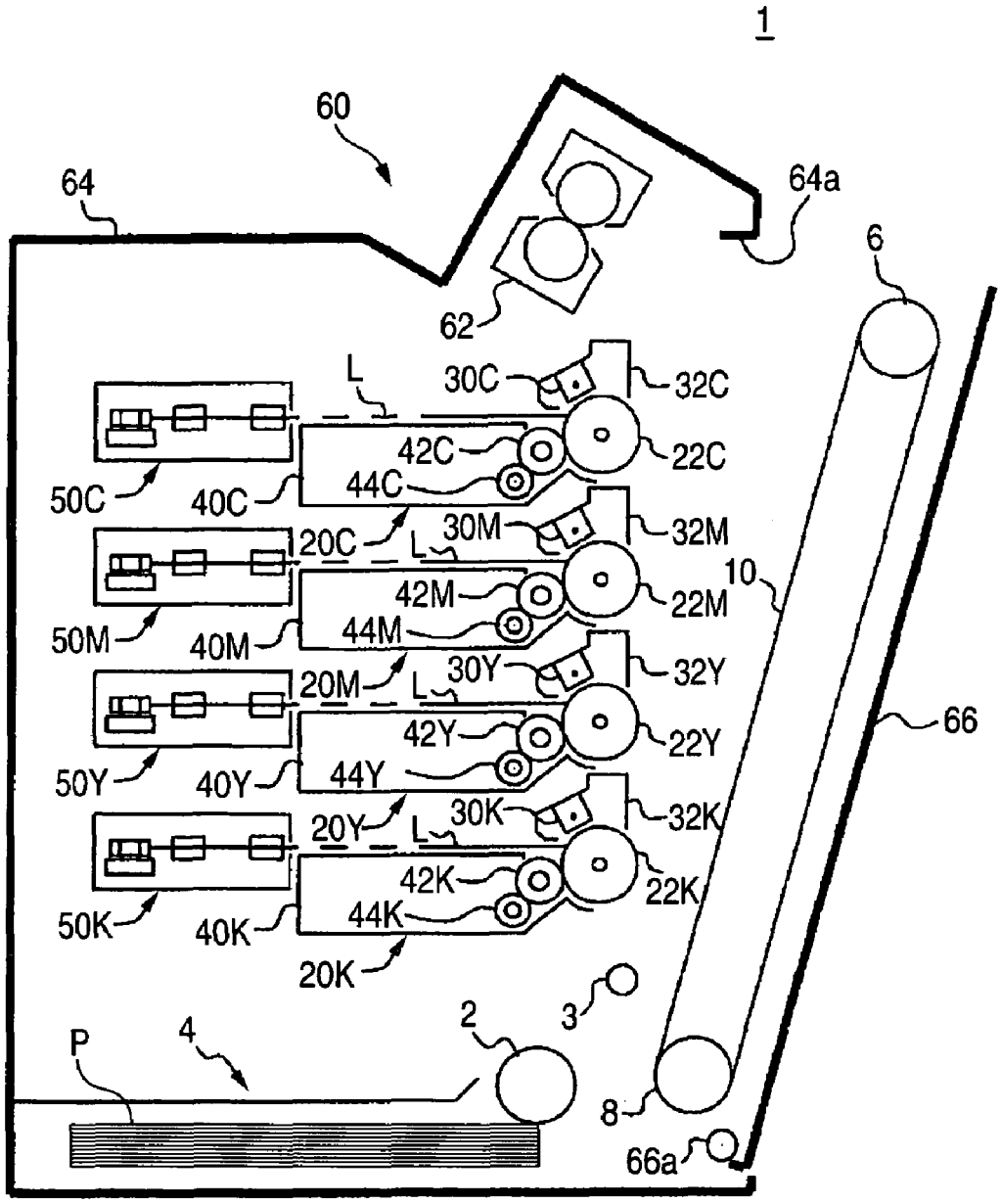
FIG. 2 is a schematic side cross-sectional view of the color laser printer in a state where a closing door is opened up to a position of 15 degrees.
Figure 3:
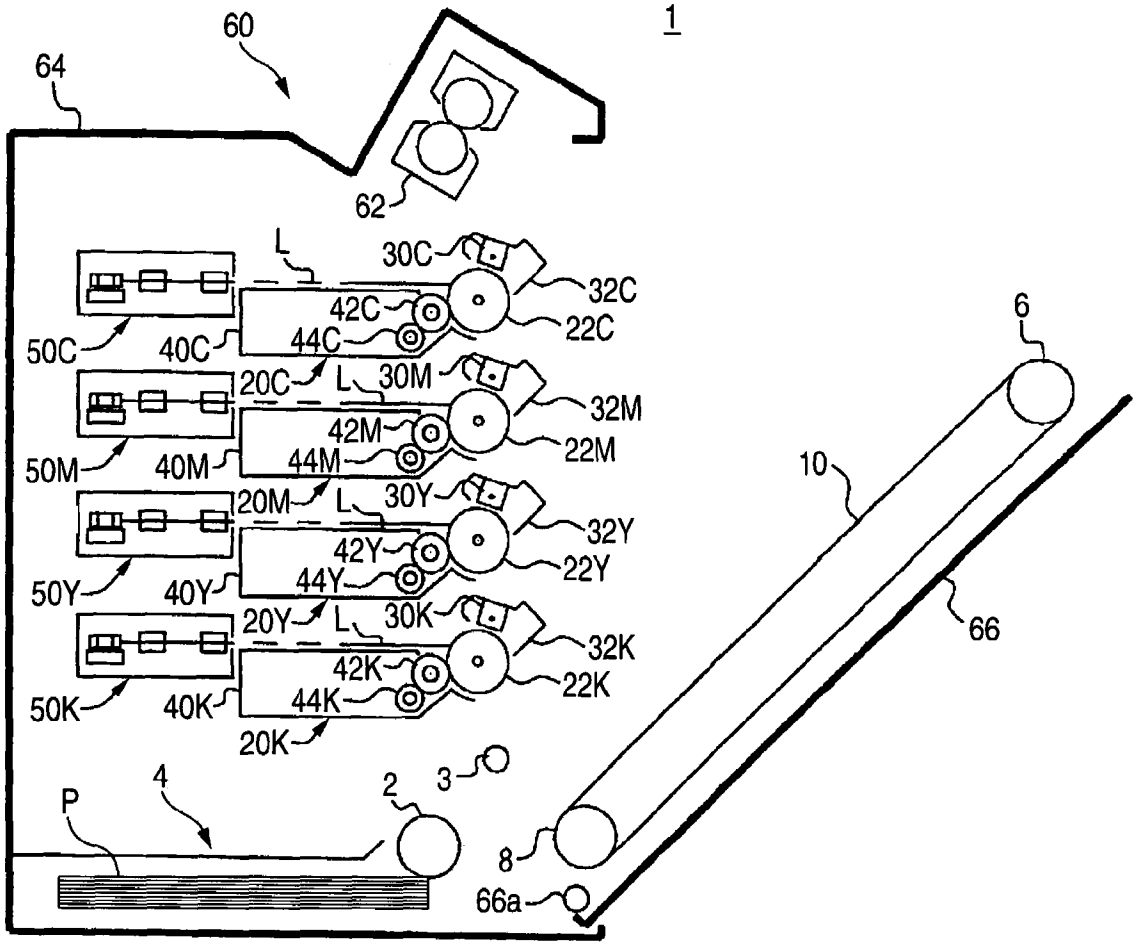
FIG. 3 is a schematic side cross-sectional view of the color laser printer in a state where the closing door is opened up to a position of 45 degrees.

More specifically, while the lid member 66 is opened from a closed position (at this time, the angle of the lid member 66 is defined as 0 degree) as indicated in FIG. 1 to a position of 15 degrees (half-opened position) as indicated in FIG. 2, the frame member 32K, 32Y, 32M and 32C is held at the position as indicated in FIG. 1.

Figure 4:
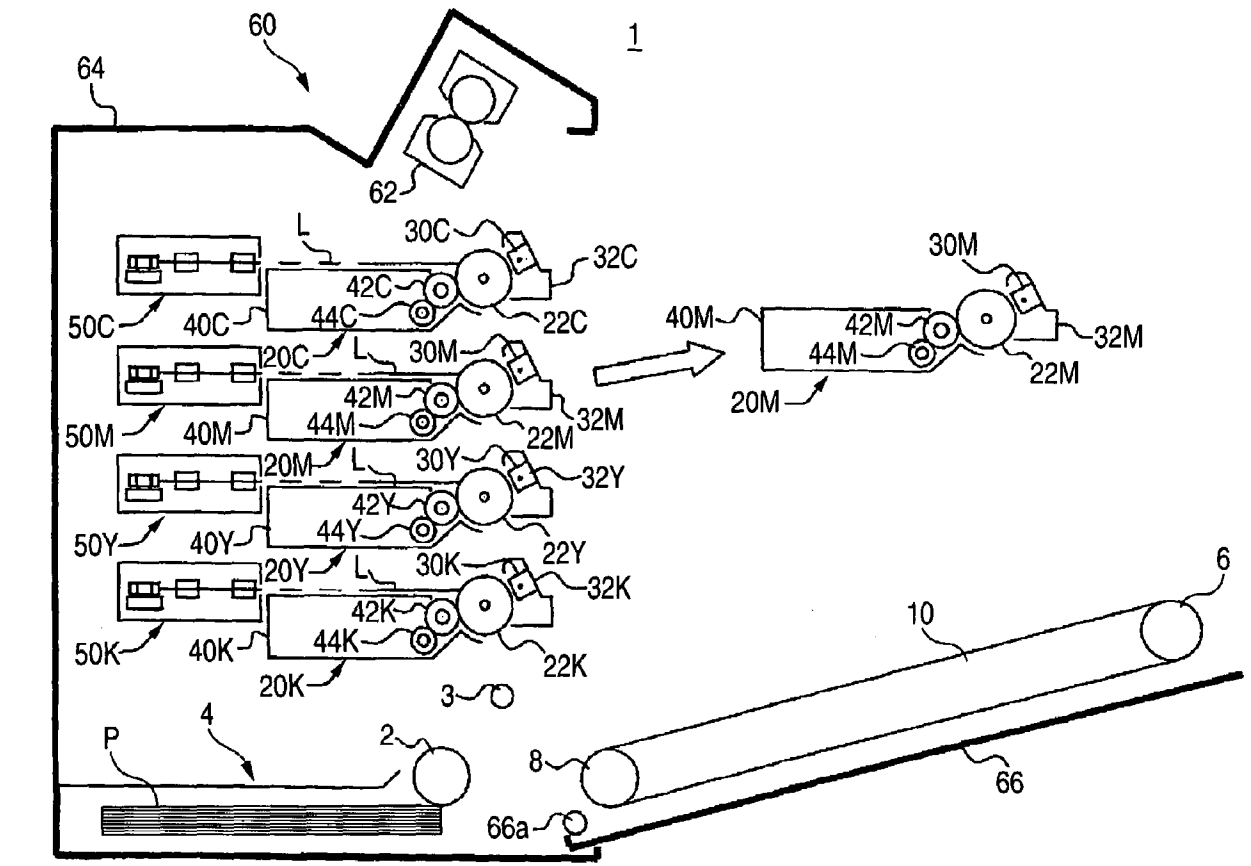
FIG. 4 is a schematic side cross-sectional view of the color laser printer in a state where the closing door is opened up to a position of 75 degrees.

And when the lid member 66 is further opened from the position of 15 degrees as indicated in FIG. 2, the frame member 32K, 32Y, 32M and 32C starts the movement from a first position to a second position in conjunction with the lid member 66. In a state where the lid member 66 is opened at a position of 75 degrees (full opened position) as indicated in FIG. 4, the frame member 32K, 32Y, 32M and 32C is located between the first position and the second position.

As described above, the frame member 32K, 32Y, 32M and 32C is rotated about 90 degrees around the rotation axis of the photosensitive drum 22K, 22Y, 22M and 22C in conjunction with an operation of the lid member 66 to move from the closed position to the opened position.

Hereinafter, a structure for operating the lid member 66 and the frame member 32K, 32Y, 32M and 32C in conjunction will be described.

Figure 5:
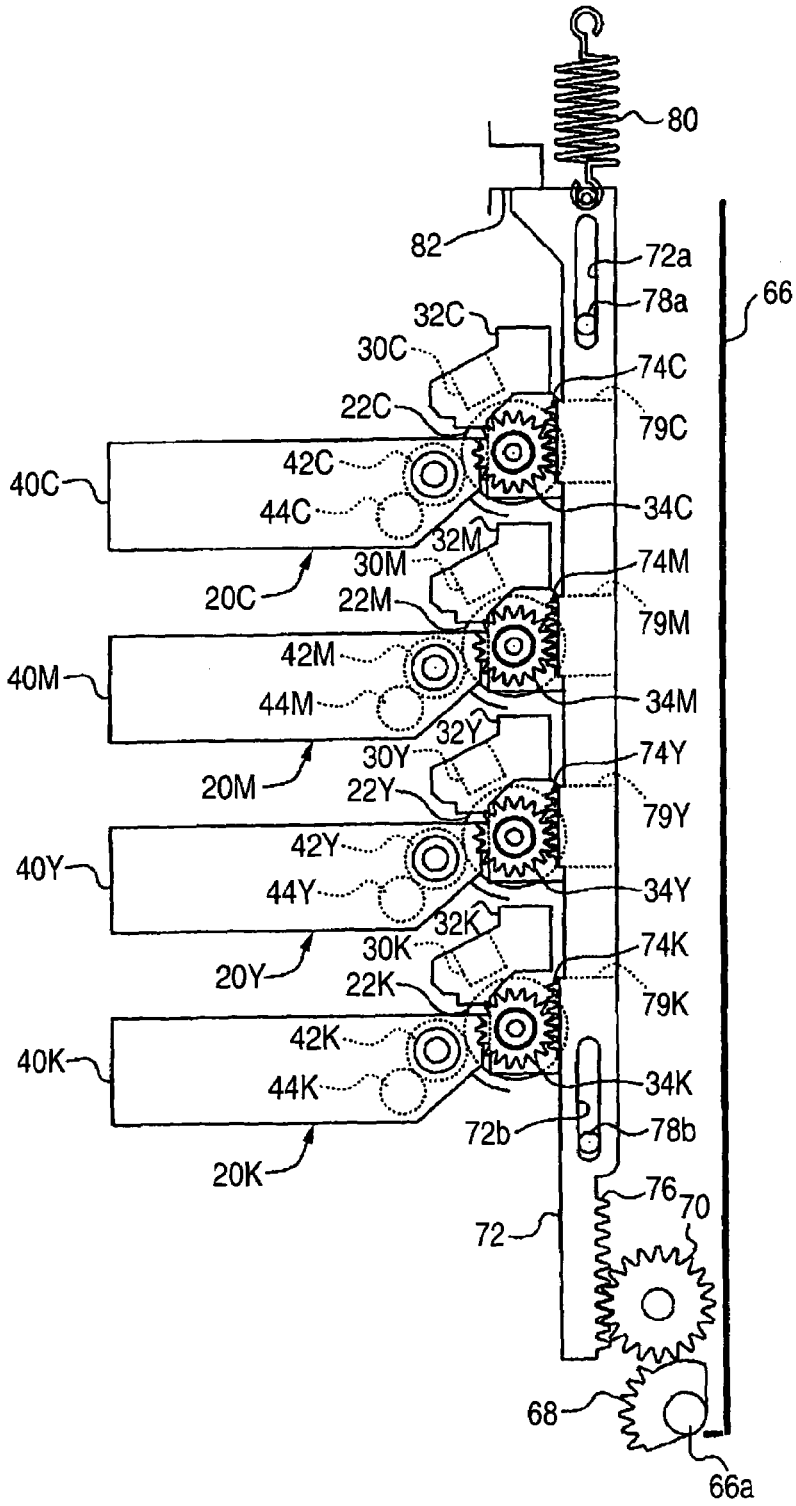
FIG. 5 is an explanatory view for explaining a power transmission structure from the closing door to the frame member.

As shown in FIG. 5, a frame gear 34K, 34Y, 34M and 34C having the central axis identical to the rotation axis of the frame member 32K, 32Y, 32M and 32C is secured in the frame member 32K, 32Y, 32M and 32C of the process cartridge 20K, 20Y, 20M and 20C.

A door gear 68 having the central axis identical to the rotation axis 66*a* of the lid member 66 is secured in the lid member 66. Herein, the door gear 68 is partially formed with the teeth in the circumferential direction, and does not mesh with an intervening gear 70 (FIG. 5), while the lid member 66 is positioned from 0 to 15 degrees, and meshes with the intervening gear 70 (FIG. 6) when the lid member 66 is opened beyond 15 degrees.

The main frame 64 is provided with the intervening gear 70 axially supported rotatably around the rotation axis parallel to the rotation axis 66*a* of the lid member 66 at a lower end position of the opening portion 64*a*, and that can mesh with the door gear 68.

A long slide member 72 is provided at an edge position of the opening portion 64*a*.

The slide member 72 is formed with long holes 72*a* and 72*b* at two upper and lower positions, in which the guide shafts 78*a* and 78*b* secured to the main frame 64 are inserted into the long holes 72*a* and 72*b*. Therefore, the slide member 72 is slidable on the main frame 64 up and down in the vertical direction.

An upper end of the slide member 72 is connected via a spring 80 to the main frame 64, and always pulled in the upper direction. A movable upper range of the slide member 72 is restricted by a stopper 82 of the main frame 64.

The slide member 72 is formed on the straight line with the rack gears 74K, 74Y, 74M and 74C meshing with the frame gears 34K, 34Y, 34M and 34C provided in the frame members 32K, 32Y, 32M and 32C in the process cartridges 20K, 20Y, 20M and 20C, respectively, as well as a rack gear 76 meshing with the intervening gear 70 at a lower end position of the opening portion 64*a*, and the notch portions 79K, 79Y, 79M and 79C which are as large as to allow the frame gear 34K, 34Y, 34H or 34C to pass (particularly when the process cartridge 20K, 20Y, 20M or 20C is mounted or demounted).

With such structure, in a process of opening the lid member 66 from the closed state to the open state, the door gear, 68 and the intervening gear 70 are not meshed, so that the slide member 72 is directly contacted with the stopper 82, and the frame member 32K, 32Y, 32M and 32C of the process cartridge 2.0K, 20Y, 20M and 20C are kept at the first position and not displaced, while the lid member 66 is opened from the closed position up to a position of 15 degrees, as shown in FIG. 5.

When the lid member 66 is opened to the position of 15 degrees, the door gear 68 and the intervening gear 70 are meshed. Therefore, when the lid member 66 is further opened, the slide member 72 is moved downwards against a bias of the sprint 80 with the rotation of the intervening gear 70. Whereby, the frame gears 34K, 34Y, 34M and 34C are rotated, so that the frame members 32K, 32Y, 32M and 32C are displaced toward the second position.

Figure 6:
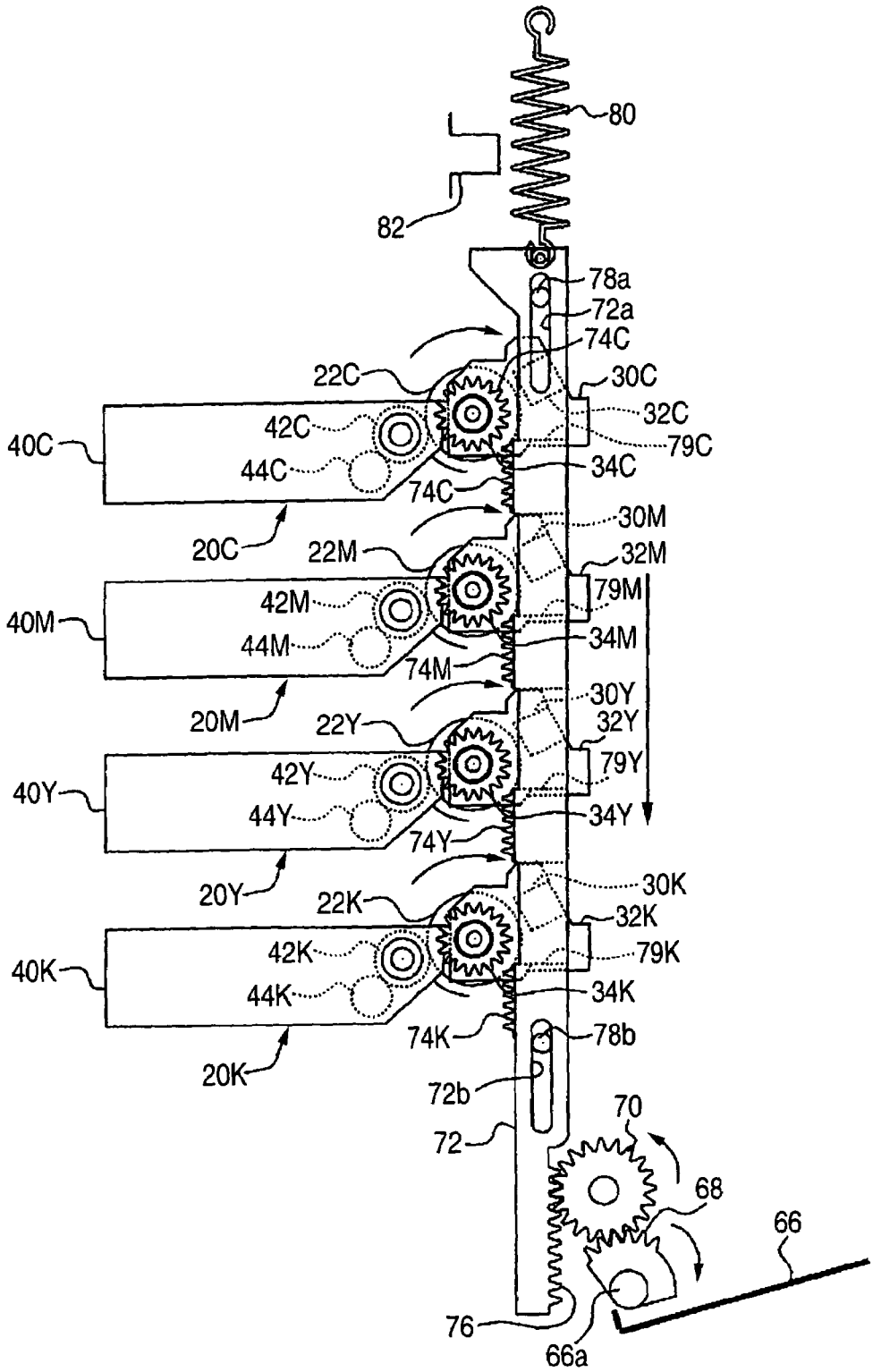
FIG. 6 is a perspective view of a process cartridge.
Figure 7:
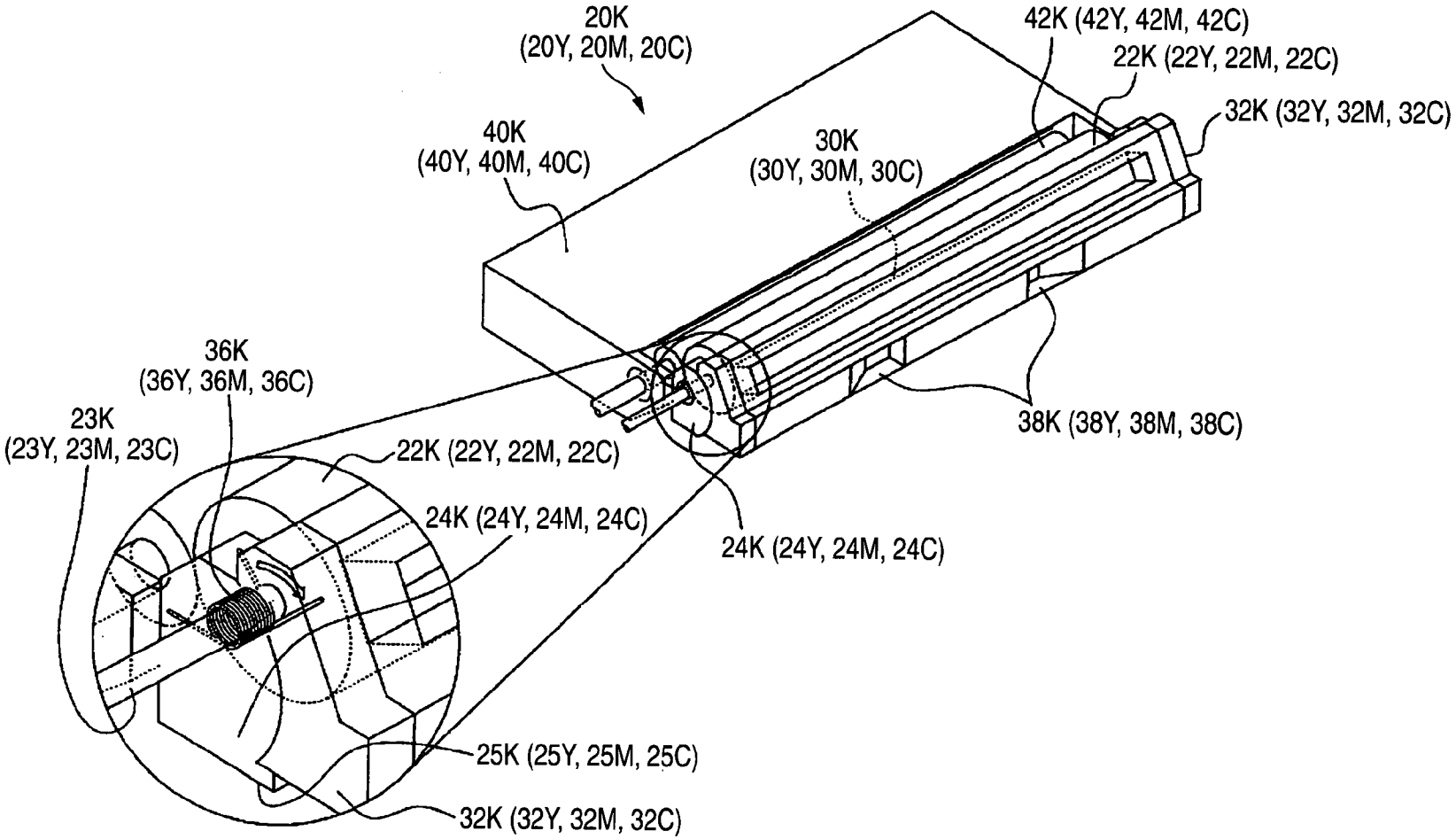
FIG. 7 is an explanatory view of a grip for the process cartridge.

When the lid member 66 is further opened, the rack gear 74K, 74Y, 74M and 74C of the slide member 72 and the frame gear 74K, 34Y, 34M and 34C are not meshed, so that the frame gear 34K, 34Y, 34M and 34C is opposed to the notch portion 79K, 79Y, 79M and 79C, as shown in FIG. 6. Herein, the process cartridge 20K, 20Y, 20M and 20C is provided with a spring 36K, 36Y, 36M and 36C for holding the frame member 32K, 32Y, 32M and 32C at the second position through a shaft 23K, 23Y, 23M and 23C of the photosensitive drum 22K, 22Y, 22M and 22C, as shown in FIG. 7. The spring 36K, 36Y, 36M and 36C has one end contacted with a stopper portion (not shown) provided in a supporting member 24K, 24Y, 24M and 24C (secured to the developing unit 40K, 40Y, 40M and 40C) for rotatably supporting the shaft 23K, 23Y, 23M and 23C of the photosensitive drum 22K, 22Y, 22H and 22C. The other end of the spring 36K, 36Y, 36M and 36C is contacted with a stopper portion (not shown) provided in the frame member 32K, 32Y, 32M and 32C. Whereby, the frame member 32K, 32Y, 32M and 32C is urged in a direction from the first position to the second position by the spring 36K, 36Y, 36M and 36C. The supporting member 24K, 24Y, 24M and 24C is formed with a protruding portion 25K, 25Y, 25M and 25C that is contacted with the lower face of the frame member 32K, 32Y, 32M and 32C, whereby the frame member 32K, 32Y, 32M and 32C is positioned. Therefore, even when the frame gear 34K, 34Y, 34M and 34C and the rack gear 74K, 74Y, 74M and 74C are not meshed, the frame member 32K, 32Y, 32M and 32C is kept at the second position, because the lower face is contacted with the protruding portion 25 owing to a bias force of the spring 36K, 36Y, 36M and 36C. The frame member 32K, 32Y, 32M and 32C is rotatable only between the first position and the second position, and kept at the second position, because the lower face of the frame member 32K, 32Y, 32M and 32C is contacted with the protruding portion 25K, 25Y, 25M and 25C by being urged in one direction by the spring 36K, 36Y, 36M and 36C and, as previously described.

Figure 8:
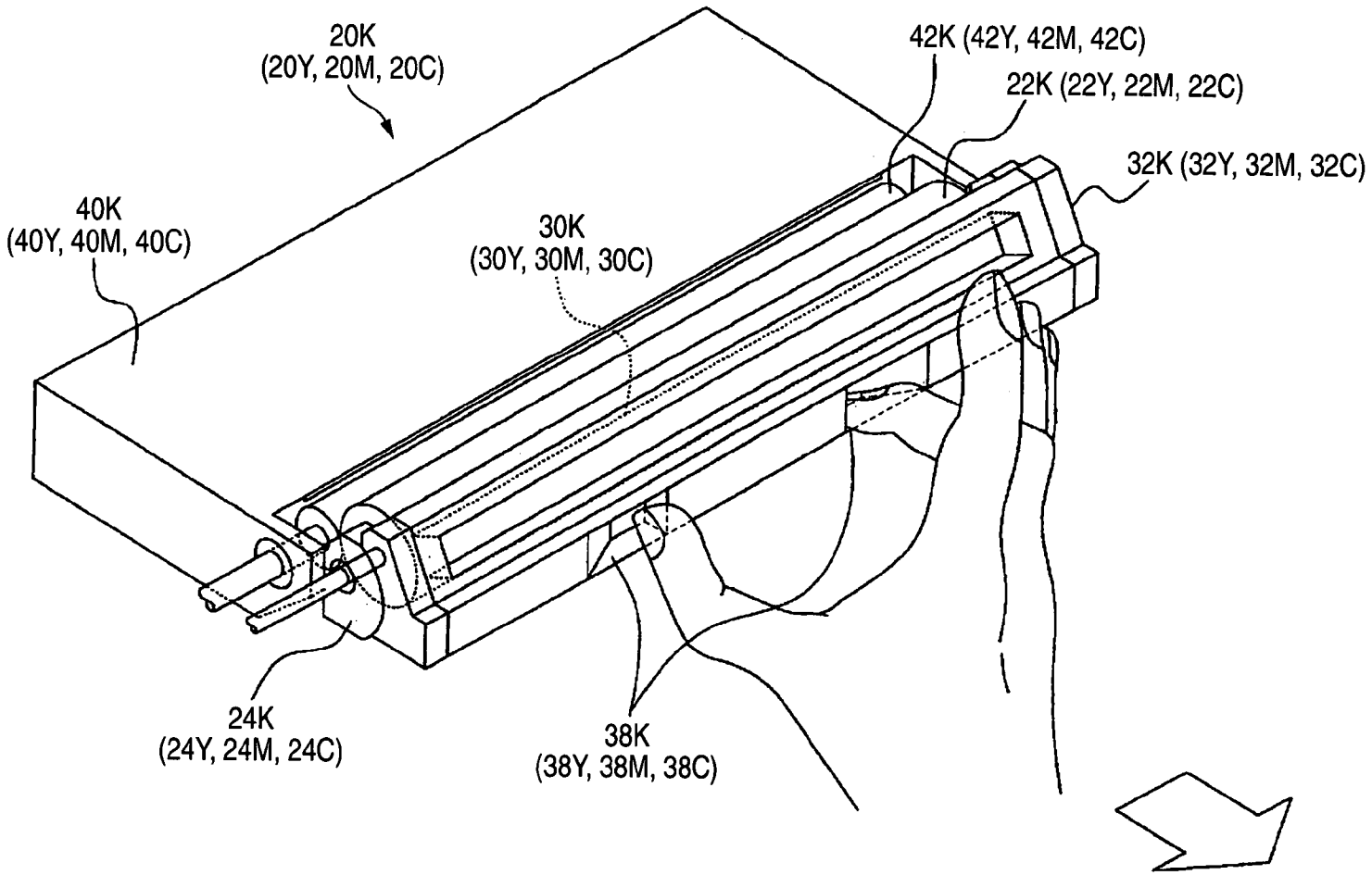
FIG. 8 is an explanatory view of either mounting or demounting the process cartridge.

The process cartridge 20K, 20Y, 20M and 20C can be mounted or demounted in a state of FIG. 6. Herein, a grip (concave portion in this embodiment) 38K, 38Y, 38M and 38C for allowing the user to hold the process cartridge 20K, 20Y, 20M and 20C in mounting or demounting is formed on the outer face of the frame member 32K, 32Y, 32N and 32C, whereby the process cartridge 20K, 20Y, 20M and 20C can be easily mounted or demounted, as shown in FIG. 8.

In a state where the lid member 66 is at the closed position, the slide member 72 is pulled upwards by the spring 80, exerting a closing force on the lid member 66, but the lid member 66 is kept open even when the user does not hold the lid member 66, because a gravitational force on the lid member 66 and the members (drive roller 6, follower roller 8, sheet conveying belt 10) borne on this lid member 66 is greater than the closing force.

On the other hand, in a process of closing the lid member 66, the slide member 72 is moved upwards in conjunction with an operation of closing the lid member 66. When the rack gear 74K, 74Y, 74M and 74C of the slide member 72 meshes with the frame gear 34K, 34Y, 34M and 34C, the frame member 32K, 32Y, 32M and 32C starts to be moved from the second position to the first position.

Thereafter, when the lid member 66 is at the position of 15 degrees, the door gear 68 and the intervening gear 70 are not meshed. Therefore, the slide member 72 is pulled upwards by the spring 80 and moved, and stopped at the position against the stopper 82. Accordingly, the frame gear 34K, 34Y, 34M and 34C is rotated by the rack gear 74K, 74Y, 74M and 74C of the slide member 72, so that the frame member 32K, 32Y, 32M and 32C is moved to the first position.

In the color laser printer 1 of the embodiment, each photosensitive drum 22K, 22Y, 22M and 22C functions as the image carrier, each charger 30K, 30Y, 36M and 30C functions as the processing device, the main frame 64 functions as the main frame, and the lid member 66 functions as the closing member. Each frame gear 34K, 34Y, 34M and 34C functions as the engaged portion, the slide member 72 functions as the engaging member, and the frame gears 34K, 34Y, 34M and 34C, the door gear 68, the intervening gear 70 and the slide member 72 function as the moving mechanism. The sheet conveying belt 10 functions as the transfer unit, and each spring 36K, 36Y, 36M and 36C, each protruding portion 25K, 25Y, 25M and 25C (also called the direct contact portion), and the lower face (contacted portion) of each frame member 32K, 32Y, 32M and 32C function as the holding mechanism.

As described above, in the color laser printer 1 of the embodiment, it is possible to prevent the user from touching the photosensitive drum 22K, 22Y, 22M and 22C in a state where the lid member 66 is opened. In the color laser printer 1, no dedicated parts for covering the photosensitive drums 22K, 22Y, 22M and 22C are not employed, whereby the printer 1 is reduced in size and cost.

In the color laser printer 1, the frame member 32K, 32Y, 32M and 32C are rotated around the central axis of the photosensitive drum 22K, 22Y, 22M and 22C as the rotation axis, whereby the distance between the charger 30K, 30Y, 30N, 30C and the photosensitive drum 22K, 22Y, 22M, 22C is kept constant, irrespective of the position of the frame member 32K, 32Y, 32M and 32C. Therefore, even if the first position is more or less changed due to a variation in the movement amount of the frame member 32K, 32Y, 32M and 32C, the charger 30K, 30Y, 30M and 30C is normally operated on the photosensitive drum 22K, 22Y, 22M and 22C.

In the color laser printer 1, since the charger 30K, 30Y, 30M and 30C is provided on the photosensitive drum 22K, 22Y, 22M and 22C without contact, the surface of the photosensitive drum 22K, 22Y, 22M and 22C is not damaged by movement of the charger 30K, 30Y, 30M and 30C.

In the color laser printer 1, the frame member 32K, 32Y, 32M and 32C is not moved from the first position to the second position, until the lid member 66 is opened to some extent from the closed position, whereby the frame member 32K, 32Y, 32M and 32C is out of contact with the sheet conveying belt 10.

Particularly, in the color laser printer 1, since the rotation axis 66*a* of the lid member 66 is parallel to the rotation axes of the photosensitive drums 22K, 22Y, 22M and 22C, the photosensitive drums 22K, 22Y, 22M and 22C are effectively protected. That is, when a closing door (transverse closing door) rotatable around the rotation axis perpendicular to the rotation axis of the photosensitive drum 22K, 22Y, 22M and 22C is employed instead of the lid member 66, the distance between the photosensitive drum 22K, 22Y, 22M and 22C and the sheet conveying belt 10 is longer on the side apart from the rotation axis of the closing door, in which the photosensitive drum is touched by the user, but the distance between the photosensitive drum 22K, 22Y, 22M and 22C and the sheet conveying belt 10 is shorter on the side nearer to the rotation axis of the closing door, in which the frame member 32K, 32Y, 32M and 32C is not moved to the second position.

In the color laser printer 1, since the grip 38R, 38Y, 38M and 38C is formed on the outer face of the frame member 32K, 32Y, 32M and 32C, the user can easily mount or demount the process cartridge, and be effectively prevented from touching the photosensitive drum 22K, 22Y, 22M and 22C. In addition, since the grip 38K, 38Y, 38M and 38C is concave portion formed the outer face of the frame member 32K, 32Y, 32M and 32C, there is no excess bulge, contributing to the reduction in the size of the color laser printer 1. Even in a state where the process cartridge 20K, 20Y, 20M and 20C is singly provided, the frame member 32K, 32Y, 32M and 32C is kept at the second position, facilitating the mounting or demounting operation.

In this color laser printer 1, since four process cartridges 20K, 20Y, 20M and 20C are disposed in parallel to face the opening portion 64*a*, a desired process cartridge 20K, 20Y, 20M and 20C is easily mounted or demounted. Moreover, since the entire conveyance path for the sheet P is exposed to the user, a sheet removal operation for removing the sheet is easily performed, when there is a sheet jam.

In addition, the process cartridge 20K, 20Y, 20M and 20C for use in the color laser printer 1 has a reduced thickness in the up and down direction, when the frame member 32K, 32Y, 32N and 32C is moved from the first position to the second position. That is, when the frame member 32K, 32Y, 32M and 32C is at the first position, the charger 30K, 30Y, 30M and 30C is disposed not to overlap the photosensitive drum 22K, 22Y, 22M and 22C in the direction where the process cartridge 20K, 20Y, 20M and 20C is mounted or demounted. On the other hand, when the frame member 32K, 32Y, 32M and 32C is at the second position, the charger 30K, 30Y, 30M and 30C is disposed to overlap the photosensitive drum 22K, 22Y, 22M and 22C in the direction where the process cartridge 20K, 20Y, 20M and 20C is mounted or demounted. Therefore, the thickness of the process cartridge 20K, 20Y, 20M and 20C in a direction orthogonal to the direction where the process cartridge 20K, 20Y, 20M and 20C is mounted or demounted is reduced in performing the mounting or demounting operation. Accordingly, even when the process cartridge 20K, 20Y, 20M and 20C is disposed in proximity within the printer 1, the process cartridge 20K, 20Y, 20M and 20C is easily mounted or demounted. As a result, the color laser printer 1 is effectively made smaller.

Although one embodiment of the invention has been described above, the present invention may be implemented in various forms.

For example, the color laser printer 1 of the embodiment, four frame members 32K, 32Y, 32N and 32C are moved at the same time in conjunction with an opening or closing operation of the lid member 66. Alternatively, four frame members 32K, 32Y, 32M and 32C may start to be moved at different timings. More specifically, the frame member 32K, 32Y, 32M and 32C nearer to the rotation axis 66*a* of the lid member 66 may start to be moved later, along with an opening operation of the lid member 66 from the closed position to the opened position. The above described configuration is easily realized by changing the position of the rack gear 74K, 74Y, 74M and 74C in the slide member 72.

Also, for example, the frame member 32K, 32Y, 32M and 32C nearer to the rotation axis 66*a* of the lid member 66 may have a smaller amount of movement relative to the amount of movement of the lid member 66. The above configuration is easily realized by increasing the diameter of the frame gear 34K, 34Y, 34M and 34C nearer to the rotation axis 66*a* of the lid member 66.

Although in the embodiment described above, the invention is applied to the color laser printer 1, the invention may be also applied to the color facsimile apparatus or the color copying machine.

According to the image forming apparatus of the present invention, the image carrier is prevented from being touched by the user while the opening portion of the main frame is opened. Particularly, because the image carrier is protected by moving the processing device, the apparatus has a smaller size and lower cost than when any specific part for protecting the image carrier is provided.

According to another aspect of the present invention, the image forming apparatus is characterized in that the moving mechanism moves the frame member from the second position to the first position in conjunction with an operation of the lid member to move from the opened position to the closed position. Whereby, the processing device is restored to the position acting on the image carrier by a closing operation of the lid member.

According to another aspect of the present invention, the frame member may be moved in conjunction with an opening or closing operation of the lid member.

For example, the moving mechanism may include an engaged portion provided on the frame member, and an engaging member provided engageably with the engaged portion to move in conjunction with an opening or closing operation of the lid member, in which the frame member is moved by performing the opening or closing operation of the lid member in a state where the engaging member engages the engaged portion. With this configuration, the frame member is mechanically linked with the lid member and moved.

According to another aspect of the present invention, the frame member may be rotated around a rotation axis as the center of rotation. With this configuration, the frame member is moved in a simple structure.

Particularly, the image carrier may be formed in the shape of drum (cylinder), and the frame member is rotated around a central axis of the image carrier as the rotation axis. Thereby, the processing device is moved in a least area, which is advantageous for making the apparatus smaller. In addition, with this configuration, since the distance between the processing device and the image carrier is kept constant at any time, the processing device can be act on the image carrier under the fixed conditions without strictly controlling the position of the processing device in the rotational direction.

According to another aspect of the present invention, a transfer unit may further be included, the transfer unit for transferring a developer image on the image carrier to the transfer medium, the transfer unit being borne on the lid member. With this configuration, since the transfer unit is moved along with the lid members when the lid member performs an opening operation, the image carrier is directly exposed to the opening portion side. However, in the image forming apparatus of the invention, a part of the image carrier on the side of the opening portion is covered by movement of the frame member, whereby the image carrier is prevented from being exposed to the opening portion side.

According to another aspect of the present invention, the processing device may be configured to act on the image carrier out of contact with the image carrier. With this configuration, when the processing device is moved, the image carrier is prevented from being damaged by the processing device.

According to another aspect of the present invention, the moving mechanism may be configured to start to move the frame member from the first position to the second position at the time when the lid member is moved from the closed position to a specified half-opened position between the closed position and the opened position, With this configuration, the frame member or the processing device is prevented from contacting with the lid member or a member moving together with the lid member that exists on the movement path of the frame member or the processing device when the frame member is moved from the first position to the second-position.

For example, the lid member may be configured to be opened or closed around a rotation axis parallel to the rotation axis of the image carrier. That is, when the lid member is opened or closed around a rotation axis perpendicular to the rotation axis of the image carrier, a portion of the image carrier far away from the rotation axis of the lid member is exposed to the opening portion side, along with an opening operation of the lid member, but a portion of the image carrier closer to the rotation axis of the lid member has a shorter distance to the lid member or the member moving together with the lid member, resulting in a problem that the frame member is not moved.

According to another aspect of the present invention, a plurality of image carriers and a plurality of processing devices may further be included, the image carriers and the processing devices acting on the image carriers, in which the moving mechanism moves each frame member supporting each of the processing device and provided movably on each of the image carriers in conjunction with an operation of the lid member. With this configuration, the plurality of image carriers are protected by the opening operation of the common lid member.

According to another aspect of the present invention, an image carrier, a processing device acting on the image carrier, and a frame member supporting the processing device and provided movably on the image carrier, in which a process cartridge is provided detachably via the opening portion in the image forming apparatus, may further be included. With this configuration, the image carrier is prevented from being touched by the user in mounting or demounting the process cartridge.

For example, the image forming apparatus may further include a grip for detaching the process cartridge from the image forming apparatus, the grip provided on the frame member supporting the processing device of the process cartridge. Thereby, the process cartridge is easily mounted or demounted. In addition, the image carrier is prevented from being touched by the user.

Further, the image forming apparatus may be configured so that the process cartridge includes a holding mechanism for holding the frame member at the second position in a state where the process cartridge is removed from the image forming apparatus. Thereby, the process cartridge is easily mounted on the image forming apparatus.

In addition, the image forming apparatus may be configured so that the processing device is disposed not to overlap the image carrier in a direction of detaching the process cartridge at the first position and to overlap the image carrier in the direction of detaching the process cartridge at the second position. Thereby, the thickness of the process cartridge in a direction orthogonal to the direction of mounting or demounting is reduced at the time of mounting or demounting the process cartridge. As a result, the process cartridge is easily mounted or demounted. Also, it is possible to contribute to smaller size of the image forming apparatus.

Further, the image forming apparatus may be configured so that a process cartridge mounted on an image forming apparatus is provided, and including an image carrier for carrying a developer image formed by developing an electrostatic latent image with a developer, a frame member for supporting processing device acting on the image carrier, the frame member being provided movably on the image carrier between a first position where the processing device acts on the image carrier and a second position different from the first position, and holding mechanism for holding the frame member at the second position. With this configuration, the processing device operates as a protective member for covering a protection subject portion on the image carrier while it is unnecessary to act on the image carrier.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

an image carrier that carries a developer image formed by developing an electrostatic latent image with a developer;

a processing device configured to act on the image carrier;

a frame member disposed to be movable with respect to the image carrier, the frame member supporting the processing device;

a main frame formed with an opening portion facing the image carrier;

a lid member disposed to be movable between an opened position in which the opening portion is opened and a closed position in which the opening portion is closed; and a moving mechanism configured to move the frame member, in conjunction with an operation of the lid member, between a first position in which the processing device acts on the image carrier and a second position in which the frame member covers a part of the image carrier.

2. The image forming apparatus according to claim 1, wherein the moving mechanism moves the frame member from the first position to the second position in conjunction with an opening operation of the lid member, the opening operation that the lid member moves from the closed position to the opened position.

3. The image forming apparatus according to claim 2, wherein the moving mechanism moves the frame member from the second position to the first position in conjunction with a closing operation of the lid member, the closing operation that the lid member moves from the opened position to the closed position.

4. The image forming apparatus according to claim 1, wherein the moving mechanism comprises: an engaged portion provided on the frame member; and an engaging member to be engaged with the engaged portion and configured to move in conjunction with the opening operation and the closing operation of the lid member, and wherein the frame member is moved by performing the opening operation and the closing operation of the lid member in a state where the engaging member being engaged with the engaged portion.

5. The image forming apparatus according to claim 1, wherein the frame member rotatably moves around a rotation axis as the center of rotation.

6. The image forming apparatus according to claim 5, wherein the image carrier is formed in a cylindrical shape, and wherein the frame member rotatably moves around a central axis of the image carrier as the rotation axis.

7. The image forming apparatus according to claim 1 further comprises a transfer unit supported by the lid member and configured to transfer a developer image on the image carrier to a transfer medium.

8. The image forming apparatus according to claim 1, wherein the processing device acts on the image carrier without being in contact with the image carrier.

9. The image forming apparatus according to claim 1, wherein the moving mechanism is configured to start moving the frame member from the first position to the second position when the lid member is moved from the closed position to a specified half-opened position.

10. The image forming apparatus according to claim 9, wherein the lid member is opened or closed around a rotation axis being parallel to a rotation axis of the image carrier.

11. The image forming apparatus according to claim 1, wherein the image carrier comprises a plurality of image carriers, wherein the processing device comprises a plurality of processing devices each configured to act on the image carriers, respectively, wherein the frame member comprises a plurality of frame members each supports the processing devices, respectively, and wherein the moving mechanism moves the plurality of frame members from the first position to the second position in conjunction with the opening operation of the lid member.

12. The image forming apparatus according to claim 1 further comprising a process cartridge configured to be detachable to the image forming apparatus through the opening portion and comprises the image carrier, the processing device, and the frame member.

13. The image forming apparatus according to claim 12 further comprising a grip provided on the frame member.

14. The image forming apparatus according to claim 12 further comprising a holding mechanism that holds the frame member at the second position in a state where the process cartridge is detached from the image forming apparatus.

15. The image forming apparatus according to claim 12, wherein the processing device is configured to be in a position where does not overlap the image carrier in a direction of detaching the process cartridge when the frame member is at the first position, and is configured to be in a position where overlaps the image carrier in the direction of detaching the process cartridge when the frame member is at the second position.

16. The image forming apparatus according to claim 1, wherein the process cartridge has a first thickness when the frame member is in the first position and the process cartridge has a second thickness when the frame member is in the second position, the first thickness being different than the second thickness.

17. The image forming apparatus according to claim 1, wherein the processing device is a charger.

18. A process cartridge mounted on an image forming apparatus, the process cartridge comprising:

an image carrier that carries a developer image formed by developing an electrostatic latent image with a developer;

a processing device configured to act on the image carrier;

a frame member that supports the processing device and disposed to be movable between a first position in which the processing device acts on the image carrier and a second position that is different from the first position; and a holding mechanism that holds the frame member at the second position in a state where the process cartridge is detached from the image forming apparatus.

19. The process cartridge according to claim 18, wherein the process cartridge has a first thickness when the frame member is in the first position and the process cartridge has a second thickness when the frame member is in the second position, the first thickness being different than the second thickness.

20. The process cartridge according to claim 18, wherein the processing device is a charger.

* * * * *